US008230915B2

(12) United States Patent
Weng

(10) Patent No.: US 8,230,915 B2
(45) Date of Patent: Jul. 31, 2012

(54) APPARATUS, SYSTEM, AND METHOD FOR DETERMINING INJECTED FLUID VERTICAL PLACEMENT

(75) Inventor: Xiaowei Weng, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 188 days.

(21) Appl. No.: 11/692,339

(22) Filed: Mar. 28, 2007

(65) Prior Publication Data

US 2008/0236836 A1 Oct. 2, 2008

(51) Int. Cl.
*E21B 47/00* (2012.01)
*E21B 47/06* (2012.01)
*E21B 43/26* (2006.01)

(52) U.S. Cl. ..... 166/250.01; 166/308.1; 166/250.1

(58) Field of Classification Search ..... 166/250.01, 166/66, 308.1, 250.1; 374/130, 131, 129, 374/1, 2; 73/152.02, 152.39
See application file for complete search history.

(56) References Cited

U.S. PATENT DOCUMENTS

| | | | | |
|---|---|---|---|---|
| 3,480,079 | A | 11/1969 | Guinn | |
| 3,795,142 | A | 3/1974 | Smith et al. | |
| 4,109,717 | A | 8/1978 | Cooke, Jr. | |
| 4,832,121 | A * | 5/1989 | Anderson | 166/250.09 |
| 5,353,873 | A | 10/1994 | Cooke, Jr. | |
| 5,509,474 | A | 4/1996 | Cooke, Jr. | |
| 6,758,271 | B1 | 7/2004 | Smith | |
| 6,789,621 | B2 * | 9/2004 | Wetzel et al. | 166/253.1 |
| 6,896,074 | B2 | 5/2005 | Cook et al. | |
| 7,055,604 | B2 | 6/2006 | Jee et al. | |
| 7,107,188 | B2 | 9/2006 | Veneruso et al. | |
| 2002/0064206 | A1 * | 5/2002 | Gysling et al. | 374/147 |

FOREIGN PATENT DOCUMENTS

WO 2004085795 A 10/2004

OTHER PUBLICATIONS

Barry Brady, Jack Elbel, Mark Mack, Hugo Morales, Ken Nolte, Bobby Poe "Cracking Rock: Progress in Fracture Treatment Design", Oilfield Review, Oct. 1992, pp. 9 and 15.*

SPE 71676—Michael Tolan; Maurice Boyle; Glynn Vvillaims; The use of Fiber Optic Distributed Temperature Sensing and Remote Hydraulically Operated Interval Control Valves for the Management of Water Production in the Douglas Field; Society of Petroleum Engineers; Oct. 2001.

SPE 76747—Tor K. Kragas, Bill F. Turnbull and Michael J. Francis; Permanent Fiber Optic Monitoring at Northstar: Pressue/Temperature System and Data Overview; Society of Petroleum Engineers; May 2002.

* cited by examiner

*Primary Examiner* — Cathleen Hutchins
(74) *Attorney, Agent, or Firm* — Michael Flynn; Robin Nava; Charlotte Rutherford

(57) ABSTRACT

An apparatus, system, and method are provided for determining injected fluid vertical placement in a formation. The apparatus includes a borehole drilled through a formation, and an injection conduit within the borehole. In one embodiment, the apparatus includes a fiber optic cable within the borehole wrapped helically around the injection conduit such that the fiber optic cable reads temperatures at specific depths and radial angles throughout the borehole. The apparatus includes a thermal insulation layer interposed between the injection conduit and the fiber optic cable such that the fiber optic cable detects the formation temperature rather than the injection conduit temperature. The apparatus includes a computer programmed to determine the vertical placement of the injected fluid within the formation based on the temperature readings. The apparatus detects an induced hydraulic fracture height, and detects whether an induced hydraulic fracture has deviated from the plane of the borehole.

21 Claims, 8 Drawing Sheets

APPARATUS, SYSTEM, AND METHOD FOR DETERMINING INJECTED FLUID VERTICAL PLACEMENT

FIELD OF THE INVENTION

This invention relates to injecting fluids into a borehole, and more particularly to real-time determination of the vertical placement of the fluid in the formation surrounding the borehole.

BACKGROUND OF THE INVENTION

Determining the fluid placement of injected fluid in a well is a long standing challenge in the oilfield and other well-related industries. When a fluid is injected into a well, it is the intention for that fluid to flow into a target region such as a particular rock formation. However, there are numerous challenges to both placement and determination of the placement of the injected fluid.

For example, the fluid may communicate with formations outside the target region by flowing behind an imperfect cement sheath around a borehole casing or by creating a fracture, which may grow through a formation, causing fluid to flow into an undesired zone. Allowing fluid into regions outside the target region is undesirable for several reasons. First, the fluid that enters zones outside the target region does not support the injection goals and is wasted. Second, fluid injected into regions outside the target region may cause communication with other zones in a well and cause a detriment to production of the target region. Finally, fluid injected into regions outside the target region may violate a duty owed by the operator either under contract, environmental, and/or other laws.

Several methods of determining injected fluid vertical placement within a borehole are known in the art. Two common methods are radioactive logging and temperature logging. Neither of these two methods can be performed in real-time while fluid is being injected, rather both determination methods require a tool to be run down the bore after the injection work is completed. Further, neither of these methods can detect borehole deviation from the fracture plane, and therefore both methods may significantly underestimate the true height of the fracture without providing any feedback that deviation has occurred. Also, radioactive logging requires the handling of radioactive tracers, and the associated environmental, regulatory and handling issues.

Other methods of determining fluid placement include tiltmeter surveys and microseismic mapping. These techniques can be utilized during a fluid injection event. However, these techniques have important limitations. They require use of a nearby offset well that must be shut down during the testing. Not every well has a nearby offset, and production shutdowns are almost always undesirable. Further, the tiltmeter survey measures small deviations in the offset well due to rock stresses, and is best for fracture treatments and not other types of injection that may not induce a fracture or significant stresses in the injected formation. Microseismic mapping requires microseismic events to detect fracture height. In boundary layers that may experience low fluid leakoff, the microseismic events may be too small to measure, and may cause the microseismic mapping to determine the fracture height inaccurately One method of estimating fracture height is a fluid efficiency test in which a pre-fracture injection is performed, and a fiber optic cable disposed within the borehole checks the temperature versus a depth profile. The fluid placement during the pre-fracture pumping is used to estimate the fracture height. However, this method can only detect the fracture height created during the test itself, which generally uses much smaller fluid volume than an actual fracture treatment resulting in significantly smaller fracture height. The proppant and other additives used during the fracture treatment introduce additional hydrostatic head and friction at the perforating holes that change the stresses on the formation and the cement sheath behind the casing. None of these effects can be modeled well for the fluid efficiency test. Further, the fluid efficiency test method does not detect borehole deviation from the fracture plane and can therefore significantly underestimate the true height of the fracture without providing feedback that a borehole-fracture deviation has occurred. This method also introduces additional fluid into a formation and thus introduces extra cost and time, and causes permeability damage to the formation. Finally, the fluid efficiency test cannot determine the actual height of the fracture as the fracture treatment occurs, or report a real time response to height growth.

It is evident that a need exists for an apparatus, system, and method for determining the vertical placement into a formation of a fluid injected into a borehole. Such an apparatus, system, and method would not require the use of an offset well, would provide vertical placement information in real-time while the fluid is injected, and would not introduce any extra fluid into formation.

It would also be desirable that such an apparatus, system, and method provide an indicator that a borehole to fracture plan deviation has occurred, and that the vertical placement indication may not be reliable because of the deviation. Accordingly, the present invention has been developed to provide such an apparatus, system, and method for determining the vertical placement of injected fluid into a formation that overcome many or all of the shortcomings in the conventional methods.

SUMMARY OF THE INVENTION

The invention provides a method for determining vertical placement of injected fluid by providing a plurality of temperature detectors, where each of the plurality of temperature detectors are configured to provide a temperature estimate at an approximately known depth of a borehole; providing a thermal insulator configured to thermally isolate the plurality of temperature detectors from an injection conduit across a zone of interest in a formation; injecting a fluid through the injection conduit into an injection zone in the formation; and determining a vertical extent of the injected fluid in the formation across the zone of interest based on the temperature estimate for each temperature detector.

In one embodiment, the method includes detecting a fracture-borehole deviation when a highest fracture indicator and a lowest fracture indicator exhibit a narrower temperature response than at least one central fracture indicator.

In one embodiment, the method includes detecting a fracture-borehole deviation when a first fracture indicator appears on a first side of the borehole at a highest observed fracture location, and a second fracture indicator appears on a second side of the borehole at a lowest observed fracture location.

In another embodiment, the temperature detectors comprise a fiber optic cable disposed through the zone of interest by helically arranging the fiber optic cable in the borehole, by helically arranging the fiber optic cable in the borehole with a configurable number of turns per borehole axial distance in the borehole, and/or by arranging the fiber optic cable into a plurality of switchback groupings where the groupings progress helically around the borehole.

In another embodiment, the method includes monitoring the vertical extent of the injection fluid, and adjusting an injection parameter based on the vertical extent. The injection parameter comprises a member selected from the group consisting of an injection fluid viscosity, an injection fluid pumping rate, and an injection fluid proppant concentration. In one embodiment, the method includes calibrating a fracture propagation model based on the vertical extent of the injected fluid, wherein calibrating the fracture propagation model comprises adjusting at least one model parameter to match a modeled fracture height to the vertical extent of the injected fluid. Each model parameter is selected from the list consisting of a formation fracture gradient, a formation Young's modulus, a fluid leakoff coefficient, and a fluid viscosity estimate.

The invention also provides an apparatus for determining the vertical placement of injected fluid including a plurality of temperature detectors, wherein each of the plurality of temperature detectors is placed at an approximately known depth and at an approximately known radial angle, within a borehole and a thermal insulator interposed between an injection conduit and the plurality of temperature detectors across a zone of interest in a formation. In one embodiment, the plurality of temperature detectors may be a plurality of axial segments of a fiber optic cable disposed within the borehole.

The apparatus further includes a pump configured to inject a fluid through the injection conduit into an injection zone in the formation, a temperature determination module configured to interpret at least one signal from the plurality of temperature detectors, and to determine a temperature estimate for each temperature detector; and a fluid placement module configured to determine a vertical extent of the injected fluid across the zone of interest based on the temperature estimate for each temperature detector.

In one embodiment the plurality of temperature detectors may a plurality of axial segments of a fiber optic cable, the fiber optic cable disposed within the borehole. The fiber optic cable may be helically arranged in the borehole with a configurable number of turns per borehole axial distance in the borehole, and/or by arranging the fiber optic cable into a plurality of switchback groupings where the groupings progress helically around the borehole.

The temperature determination module interprets at least one signal from the plurality of temperature detectors, and determines a temperature estimate for each temperature detector. The fluid placement module determines a vertical extent of the injected fluid across the zone of interest based on the temperature estimate for each temperature detector.

In another embodiment, the apparatus may further include a fracture deviation module. The fracture deviation module detects a fracture-borehole deviation based on the temperature estimate for each temperature detector, and based on the approximately known depths and the approximately known radial angles of the plurality of temperature detectors. In one embodiment, the fracture deviation module is configured to detect the fracture-borehole deviation based on a first fracture indicator occurring on one side of the borehole, and a second fracture indicator occurring on an opposite side of the borehole, with the first fracture indicator at the top of an observed region and the second fracture indicator at the bottom of an observed region.

The invention further provides a system for supplying a service for determining a vertical placement of an injected fluid. The system includes a coiled tubing unit comprising an injector head and a coiled tubing string, an optical fiber disposed within the coiled tubing string. The system further includes an injection conduit disposed within a borehole, and a bottom hole assembly (BHA) comprising a plurality of crossover ports. The crossover ports guide injected fluid from an exterior of the coiled tubing string to an interior conduit of the BHA, and the ports guide the optical fiber from an interior of the coiled tubing string to an exterior of the BHA. The BHA further comprises an insulation layer interposed between the interior conduit of the BHA and the optical fiber across a zone of interest in a formation. In one embodiment, the system further includes a pumping unit having access to an injection fluid source, the pumping unit fluidly coupled to the injection conduit.

The system further includes a controller including modules configured to functionally execute determining the vertical placement of the injected fluid. The controller includes a temperature determination module, and a fluid placement module. The apparatus may further include a fracture deviation module, a location conversion module, and an injection modification module. The location conversion module converts the axial locations along the fiber optic cable to corresponding depths in the borehole, and corresponding radial angles. The injection modification module monitors the vertical extent of the injected fluid, and adjusts and injection parameter based on the vertical extent of the injected fluid. The injection parameter comprises at least one of an injection fluid viscosity, an injection fluid pumping rate, and an injection fluid proppant concentration.

DETAILED DESCRIPTION OF THE INVENTION

Figure 1:
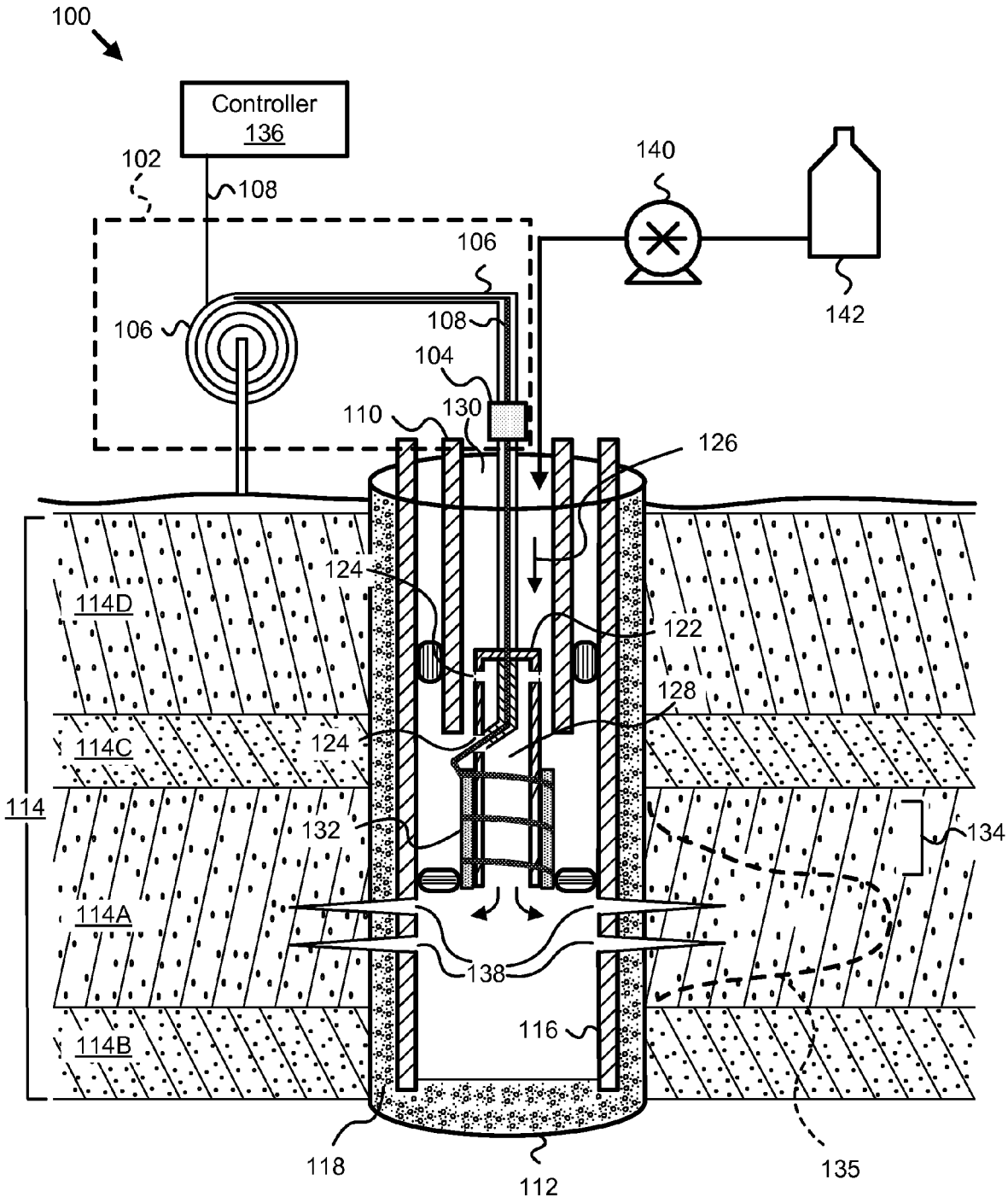
FIG. 1 illustrates one embodiment of a system for determining a vertical placement of an injected fluid in accordance with the present invention.

Many of the functional units described in this specification have been designated as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module. Any modules implemented as software for execution are implemented as a computer readable program on a computer readable medium and are thereby embodied in a tangible medium.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Reference to a signal bearing medium may take any form capable of generating a signal, causing a signal to be generated, or causing execution of a program of machine-readable instructions on a digital processing apparatus. A signal bearing medium may be embodied by a transmission line, a compact disk, digital-video disk, a magnetic tape, a Bernoulli drive, a magnetic disk, a punch card, flash memory, integrated circuits, or other digital processing apparatus memory device.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

FIG. 1 illustrates one embodiment of a system 100 for determining a vertical placement of an injected fluid in accordance with the present invention. FIG. 1 is a schematic diagram and does not show the aspects of the embodiment of the system 100 to scale. The system 100 includes a coiled tubing unit 102 comprising an injector head 104 and a coiled tubing string 106. The system 100 includes an optical fiber 108 disposed within the coiled tubing string 106. In one embodiment, the coiled tubing string 106 runs inside an injection conduit that may be a tubing string 110 within a borehole 112. The borehole 112 may be a well disposed within a formation 114. In one example, the borehole 112 is a well drilled through an injection zone 114A, and the well has a casing 116 set with cement 118. The system 100 includes an injection point 138, which may comprise perforations 138 enabling fluid communication between the well and the injection zone 114A. The well may be a hydrocarbon producing well, a waste disposal well, a water injection well, and/or any other type of well known in the art.

The system 100 further includes a bottom hole assembly (BHA) 122 that may hang from the coiled tubing string 106. The BHA 122 has crossover ports 124 such that injected fluid 126 crosses from the exterior of the coiled tubing string 106 to an interior conduit 128 of the BHA 122. In one embodiment, the injected fluid 126 starts in an annulus 130 between the coiled tubing string 106, and the tubing string 110, whereby the injection conduit comprises the tubing string 110 and the BHA interior conduit 128. The crossover ports 124 also allow the optical fiber 108 to cross from an interior of the coiled tubing string 106 to an exterior of the BHA 122. The optical fiber 108 may be a fiber optic cable suitable for the temperature and pressure environment of the borehole 112, and may include cladding and/or a protective sheath to protect the cable where required—for example at the point where the optical fiber 108 passes from the interior of the coiled tubing string 106, through one of the crossover ports 124, and to the exterior of the BHA 122.

The injection configuration of the system 100 is only one example, and other configurations are possible. For example, and without limitation, the injected fluid 126 may be pumped directly through the coiled tubing string 106. In one embodiment, the injected fluid 126 and fiber optic cable 108 are both disposed within the coiled tubing string 106, and the fiber optic cable 108 crosses from the interior of the coiled tubing string 106 to the exterior of the BHA 122 through a crossover port 124. Other arrangements of injection configurations are possible and readily understood by one of skill in the art.

The BHA 122 further includes an insulation layer 132 interposed between the injection conduit 110, 128 and the optical fiber 108 across a zone of interest in the formation 114. For example, in the embodiment of FIG. 1, the insulation layer 132 is disposed over the area from the top of a fluid injection point 138 into a boundary layer 114C, and the zone of interest comprises the area from the top of a fluid injection point 138 into a boundary layer 114C to determine if injected fluid 126 flows into the boundary layer 114C. The insulation layer 132 may be any insulating material known in the art that provides low thermal conductivity and that withstands the temperature and pressure environment of the borehole 112. The insulation layer 132 thermally isolates the optical fiber 108 from the injection conduit 110, 128.

The optical fiber 108 does not need to detect the actual temperature of the formation 114 outside the borehole 112, but rather just needs a thermal response from the formation 114 that is stronger than the thermal response from the injected fluid 126. Therefore, although lower thermal conductivity of the insulation layer 132 will improve the reliability and response time of determining an injected fluid 126 vertical extent 134 within the formation 114, thermal isolation only requires that the thermal conductivity of the insulation layer 132 be lower than the thermal conductivity of the materials between the formation 114 and the optical fiber 108. In one embodiment, the materials between the formation 114 and the optical fiber 108 comprise a well bore fluid, a casing 116, and cement layer 118.

The system 100 further comprises a controller 136 configured to determine vertical placement of the injected fluid 126, or the injected fluid 126 vertical extent 134 within the formation 114. The vertical extent 134 shown in FIG. 1 is consistent with a fracture having a half-length profile 135 on one side of the borehole 112 as shown. The half-length shown in FIG. 1 is for illustration only, as the vertical extent of the fracture profile 135 is the primary feature of interest. The fiber optic cable 108 detects temperature differences from the background in the vertical extent 134, as the vertical extent 134 is the area where both the injected fluid 126 is present, and the fiber optic cable 108 is thermally isolated from the fluid conduit 110, 128 and thereby detects the temperature difference due to the injected fluid 126 in the formation 114.

The controller 136 includes modules configured to functionally execute the steps of determining the injected fluid 126 vertical extent 134 within the zone of interest. The controller 136 includes a temperature determination module, a location conversion module, and a fluid placement module. The controller may further include an injection modification module and a fracture deviation module.

The temperature determination module, in one embodiment, interprets at least one signal from the fiber optic cable, and determines a temperature estimate for each of a plurality of axial locations along the fiber optic cable. The location conversion module converts the axial locations along the fiber optic cable to a plurality of corresponding approximate depths in the borehole, and to a plurality of corresponding approximate radial angles. The radial angles can be defined as a relative radial angle, for example the angle between temperature measurement number "65" and temperature measurement number "66," or as an absolute radial angle, for example as an azimuthal angle.

The fluid placement module determines a vertical extent 134 of the injected fluid 126 across the zone of interest based on the temperature estimate for each axial location, and based on the corresponding depth in the borehole and radial angle for each of the axial locations. The fracture deviation module detects a fracture-borehole deviation based on the temperature estimate for each axial location, and based on the corresponding depth in the borehole and radial angle for each of the axial locations. The injection modification module monitors the vertical extent of the injected fluid, and adjusts an injection parameter based on the vertical extent of the injected fluid. The injection parameter comprises at least one member selected from the group consisting of an injection fluid viscosity, an injection fluid pumping rate, and an injection fluid proppant concentration. In one embodiment, the system 100 includes a pumping unit 140 having access to an injection fluid source 142, and fluidly coupled to the injection conduit 110, 128.

Figure 2:
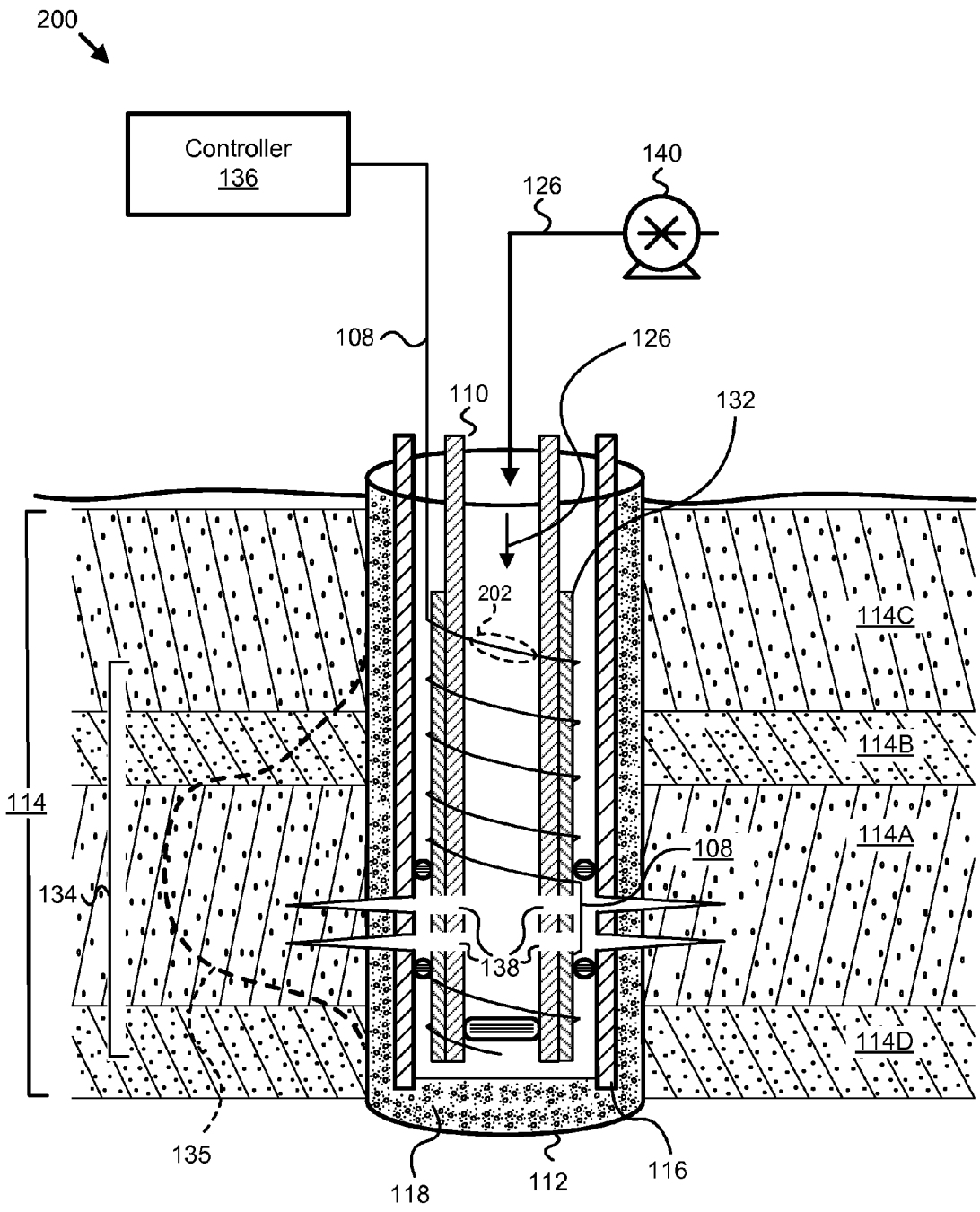
FIG. 2 illustrates one embodiment of an apparatus for determining the vertical placement of injected fluid in a formation.

FIG. 2 illustrates one embodiment of an apparatus 200 for determining the vertical placement of injected fluid 126 in a zone of interest. The apparatus 200 includes a plurality of temperature detectors 202 wherein each of the temperature detectors 202 is placed at an approximately known depth and at an approximately known radial angle within a borehole 112.

The depth needs only be known approximately, and the required precision is a function of the requirements of a given embodiment of the apparatus 200. If an injection zone 114A and a boundary layer 114B are thick, and the cost associated with an injected fluid 126 vertical extent 134 grows continuously (i.e. that each incremental increase in vertical extent 134 causes an incremental increase in cost), then the resolution for the depth of the borehole 112 may be coarse. For example, if an injection zone 114A has a 50-meter boundary layer 114B, and the cost associated with exceeding the boundary layer is a function of only the cost of excess fluid pumped into unneeded layers, then a coarse depth resolution of perhaps 5 meters is acceptable. If an injection zone 114A has a 5-meter boundary layer 114B, and the cost associated with exceeding the boundary layer is discontinuous—for example a fine is incurred if the boundary layer is exceeded (e.g. a fracture growing through 114B into 114C)—then a finer resolution of perhaps less than 1 meter is indicated. It is a mechanical step for one of skill in the art to determine the depth resolution indicated for a given embodiment of the apparatus 200 based on the cost and boundary layer information for a given embodiment of the apparatus 200, basic engineering economics principles, and the disclosures herein.

The radial angle represents the direction of the temperature detector 202 in the borehole 112, either in a relative or absolute sense (see the description referencing FIG. 1). The radial angle needs only be known approximately, and the required precision (or resolution) is a function of the requirements of a given embodiment of the apparatus 200. For example, where the azimuth of an induced fracture in the formation 114 is known in advance, and where the azimuth of the radial angle is known (i.e. the radial angle is absolute), then a resolution of 180 degrees is sufficient. Where no information about the induced fracture azimuth is known, and where no azimuthal information is available about the radial angle (i.e. the radial angle is relative), a resolution of 120 degrees will typically be sufficient.

In one embodiment, where the apparatus 200 is not configured to detect a fracture-borehole deviation, the radial angle of each temperature detector 202 does not require precision, but the temperature detectors 202 should still be distributed at various radial angles around the borehole 112—i.e. radial angle resolutions greater than 180 degrees or essentially random angles—to ensure that some of the temperature detectors 202 intersect the area of the formation 114 where injected fluid 126 flows. In one embodiment, the temperature detectors 202 do not need to be distributed about the borehole 112 where the injected fluid 126 is expected to flow into the formation 114 in true radial flow (i.e. that no permeability anisotropy exists, and that no fracture is induced), and/or that a fracture azimuth is known, and that the temperature detectors 202 are disposed within the borehole 112 to intersect the induced fracture. It is a mechanical step for one of skill in the art to determine the radial angle resolution required for a given apparatus 200 based on the known information for a planned application of a given embodiment of the apparatus 200 and the disclosures herein.

In the embodiment of FIG. 2, the injection conduit comprises a tubing string 110. In other embodiments, the injection conduit 110 may comprise a coiled tubing string, a casing 116, or a casing annulus between the casing 116 and a tubing string. The apparatus 200 further includes a thermal insulator 132 interposed between the injection conduit 110 and the plurality of temperature detectors 202 across a zone of interest in the formation. The thermal insulator 132 may be an insulated tubing wall (not shown), a casing and cement layer 116, 118, or an insulation material sheath 132. Where the thermal insulation layer 132 comprises a casing and cement layer 116, 118, the cement layer 118 may comprise a relatively low thermal conductivity cement such as a foamed cement. The thermal detectors 202 may comprise a fiber optic cable 108 placed within the cement layer 118 at a position closer to the face of the formation 114 than to the interior of the borehole 112. An insulation material sheath 132 may be affixed to a tubing string 110, to the interior of the casing 116, or to any other portion of the apparatus 200 where the insulation material sheath 132 will be interposed between the injection conduit 110 and the plurality of temperature detectors 202.

The plurality of thermal detectors 202 may comprise a plurality of temperature sensors 202 disposed within the borehole 112 in sufficient quantity and appropriate positioning to achieve the radial angle resolution and borehole 112 depth resolution determined for a given embodiment of the apparatus 200. In one embodiment, the plurality of thermal detectors 202 comprises a plurality of axial segments of a fiber optic cable 108 disposed within the borehole 112. The fiber optic cable 108 provides a plurality of temperature readings, each reading corresponding to an axial segment where each axial segment is a thermal detector, 202. The fiber optic cable 108 may be wrapped helically around at least a portion of the thermal insulator 132. The arrangement of the fiber optic cable 108, for example the number of turns of the fiber optic cable 108 per unit of borehole 112 depth, is apparent to one of skill in the art based on the disclosures herein.

For example, an apparatus 200 may have a radial angle requirement of 180 degrees, a depth resolution requirement of approximately 1 meter, and a fiber optic cable 108 with a detection resolution of one temperature reading per axial meter of the fiber optic cable 108. In the example, the fiber optic cable 108 should therefore have one turn of the fiber optic cable 108 per 2 meters of borehole 112 depth. In the example, the apparatus 200 yields one temperature reading on average for each 180 degrees of borehole 112, and yields, assuming an 11.4 cm (4.5 inch) outer-diameter insulation layer 132, about 1.02 temperature readings per 1 meter of borehole 112 depth, or about the borehole 112 depth resolution requirement.

Figure 4:
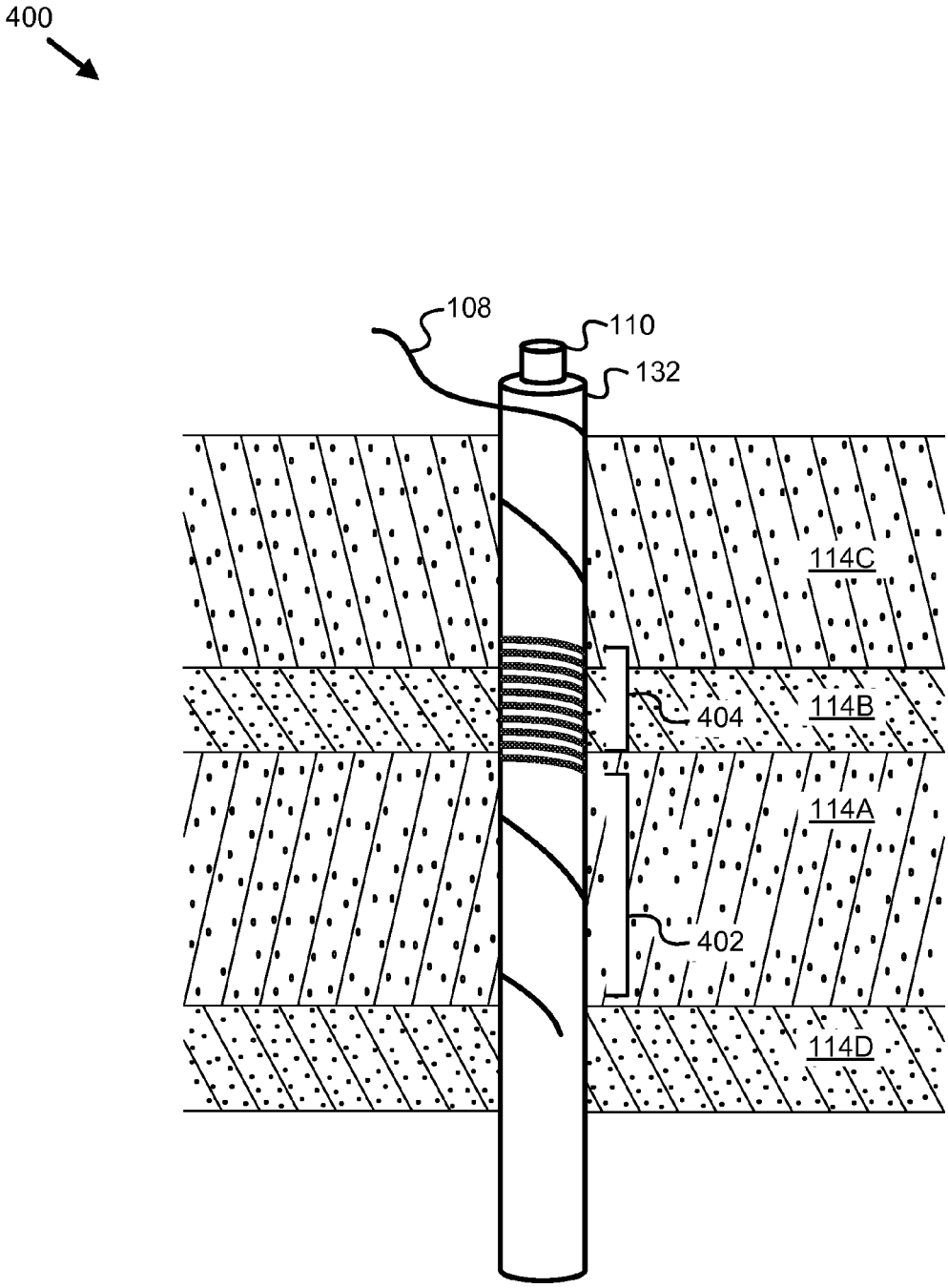
FIG. 4 is an illustration of one embodiment of a fiber optic cable with a configurable number of turns per borehole axial distance in accordance with the present invention.
Figure 5:
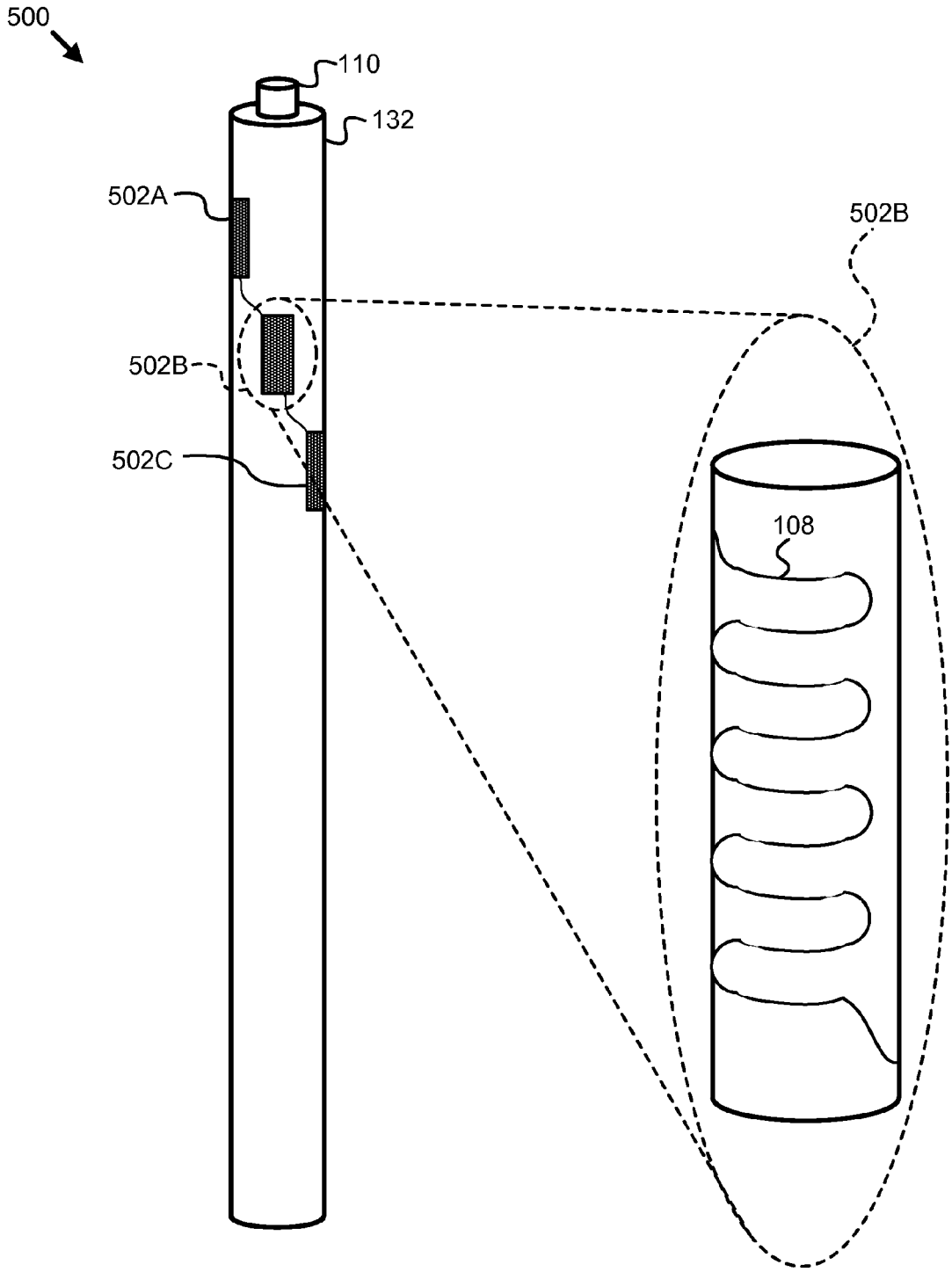
FIG. 5 is an illustration of one embodiment of a fiber optic cable with switchback groupings progressing helically around the borehole in accordance with the present invention.

In one embodiment, the fiber optic cable 108 may be disposed within the borehole 112 across a zone of interest, in a helical arrangement, a helical arrangement with a configurable number of turns per borehole 112 axial distance (refer to the description referencing FIG. 4), and/or with a plurality of groupings wherein the groupings progress helically around the borehole (refer to the description referencing FIG. 5). The groupings each comprise a specified axial length of the fiber optic cable 108 disposed within a defined radial angle sweep (less than or equal to the radial angle requirement) and borehole 112 depth (less than or equal to the borehole depth resolution requirement). The zone of interest comprises any area within the formation 114 where a vertical extent 134 of the injected fluid 126 should be monitored. For example, the zone of interest may comprise the injection zone 114A and a boundary layer 114B.

The selection of the arrangement of a fiber optic cable 108 is a function of the required depth resolution and radial resolution of a given apparatus 200, the long-term bend radius allowed by a given fiber optic cable 108, and the axial resolution for temperature readings of a given fiber optic cable 108. Long-term bend radius fiber optic cables 108 of about 17 mm are available as a standard commercial part, and axial resolutions for temperature readings of about 1 meter are standard, while axial resolutions lower than 1 meter are available where the cost is justified. The present invention is independent of the physical manifestation of the temperature detectors 202, and systems that are more capable or less capable than those listed are contemplated within the scope of the invention. However, the standard specifications listed above are sufficient for one of skill in the art to design an apparatus 200 for any standard borehole 112 application based on the fiber optic cable 108 arrangements and other disclosures provided herein.

In one embodiment, the temperature detectors 202 comprise a plurality of axial segments of a fiber optic cable 108 that continues below a fluid injection point 138 as illustrated in the embodiment of FIG. 2. The fiber optic cable 108 may have a protective layer and/or alternate arrangement when crossing the fluid injection point 138 to prevent damage to the fiber optic cable 108 from the injected fluid 126. In one embodiment, each temperature detector 202 comprises an axial segment of the fiber optic cable 108 approximately equal to the length of the axial resolution of the fiber optic cable 108. For example, the fiber optic cable 108 may have an axial resolution of 1 meter, and each temperature detector 202 may comprise a 1 meter axial segment of the fiber optic cable 108.

The apparatus 200 further comprises a pump 140 configured to inject a fluid through the injection conduit 110 into an injection zone 114A of the formation 114. The pump 140 may be a pump to inject fluid into the formation for disposal, pressure maintenance, and the like. In one embodiment, the pump 140 may be configured to inject fluid into the formation 114 at a sufficient pressure to hydraulically fracture the formation 114.

The apparatus 200 further includes a plurality of modules configured to functionally execute determining a vertical extent 134 of the injected fluid 126 in the zone of interest based on the temperature indicated by each of the temperature detectors 202. The modules may be included on a controller 136 that may be part of one or more computers. The apparatus 200 includes a temperature determination module, and a fluid placement module. In one embodiment, the apparatus 200 further includes a fracture deviation module.

Figure 3:
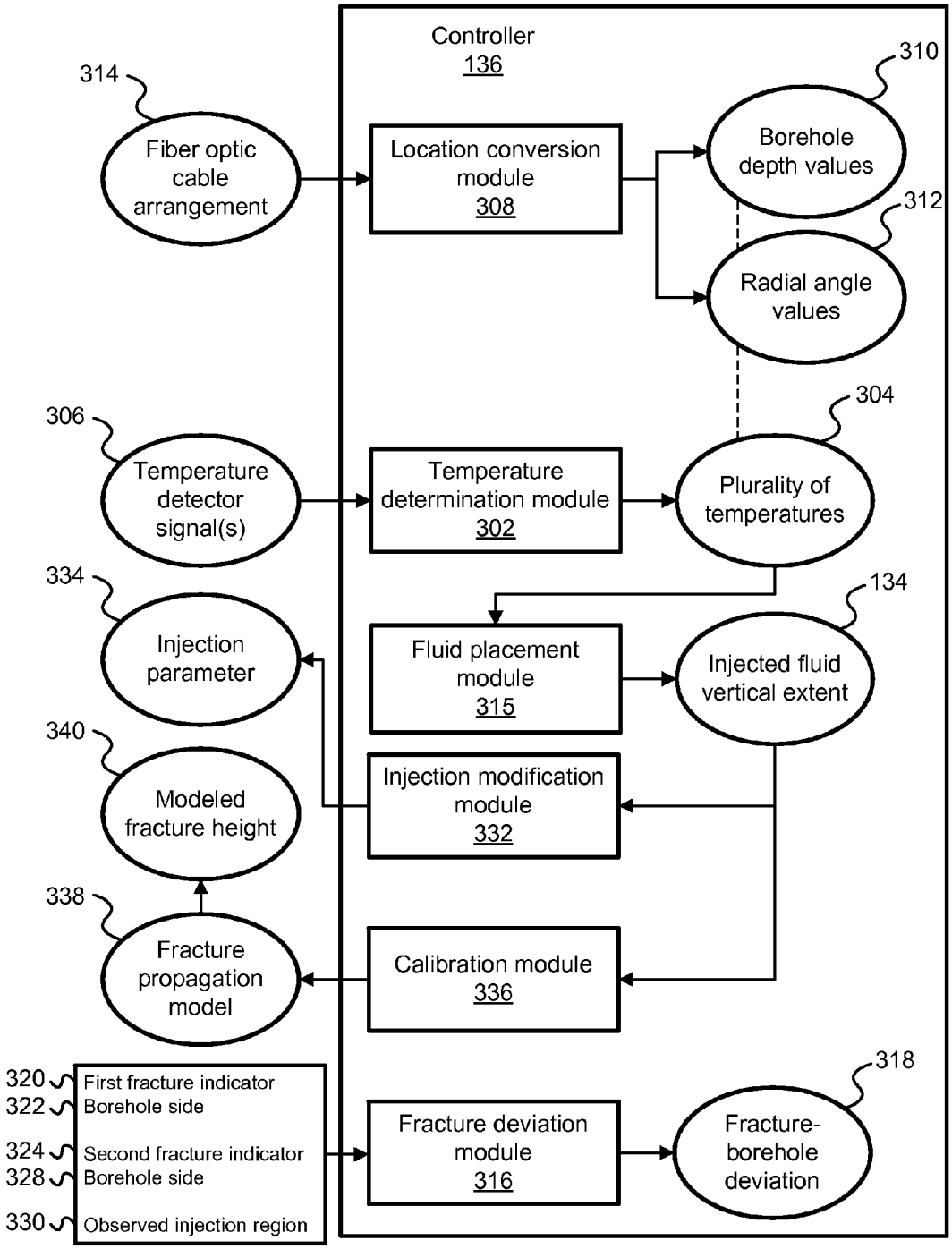
FIG. 3 is an illustration of a controller in accordance with the present invention.

FIG. 3 is an illustration of a controller 136 in accordance with the present invention. The controller 136 includes a temperature determination module 302 that interprets at least one signal 306 from the plurality of temperature detectors 202, and determines the temperatures 304 indicated by each temperature detector 202. In one embodiment, the temperature determination module 302 accepts a light scatter signal 306 from a fiber optic cable 108, and determines a plurality of temperatures 304, each temperature 304 corresponding to an axial location along the fiber optic cable 108. In another embodiment, the temperature determination module 302 reads electrical signals 306 from a plurality of temperature sensors disposed within the borehole 112, and interprets the electrical signals 306 as temperature readings 304. The temperature determination module 302 may read a signal 306 over a datalink or network to interpret the plurality of temperatures 304.

The controller 136 may include a location conversion module 308 configured to convert the axial locations along the fiber optic cable 108 to corresponding approximate depths 310 in the borehole 112, and to corresponding approximate radial angles 312. The radial angles 312 may be relative radial angles and/or absolute radial angles.

In one embodiment, the location conversion module 308 stores a description of the axial length along the fiber optic cable 108 with the corresponding borehole depth 310 and radial angle 312 values. In an alternate embodiment, the location conversion module 308 references a description 314 of the arrangement of the fiber optic cable 108 and determines the borehole depth 310 and radial angle 312 values for a given axial length along the fiber optic cable 108 according to the description of the arrangement of the fiber optic cable 108. For example, the description 314 may include a piecewise mathematical function describing the fiber optic cable 108 position—such as "50 meters vertical, next 50 meters 5 turns per meter clockwise on a 12-centimeter OD surface", and the like. The data may be stored in a standardized tabular format. It is a mechanical step for one of skill in the art to set up data storage conventions and to calculate borehole depth 310 and radial angle 312 values for axial positions on a fiber optic cable 108 given a mathematical description of the fiber optic cable 108 arrangement in a borehole 112.

In one embodiment, the location conversion module 308 comprises stored information, such as a lookup table, providing corresponding borehole depth 310 and radial angle 312 values for each temperature detector 202. In one embodiment, the apparatus 200 uses a plurality of temperature sensors 202, and stores the borehole depth 310 and radial angle 312 values corresponding to each of the sensors 202. In an alternate embodiment, the apparatus 200 uses a fiber optic cable 108 and stores the borehole depth 310 and radial angle 312 values for predefined axial lengths along the fiber optic cable 108.

The controller 136 includes a fluid placement module 315 that determines a vertical extent 134 of the injected fluid 126 across the zone of interest based on the temperature 304 estimates for each temperature detector 202. In one embodiment, the fluid placement module 315 determines a vertical extent 134 of the injected fluid 126 in the zone of interest based on the plurality of temperatures 304, and the corresponding borehole depth 310 and radial angle 312 values for each of the temperatures 304. The zone of interest includes the segments of the formation 114 wherein temperature detectors 202 are present, and thermally isolated from the injection conduit 110, 128. The fluid placement module 315 may ignore temperatures 304 for temperature detectors 202 that are not thermally isolated from the injection fluid conduit 110, 128, for example the fluid placement module 315 may ignore temperatures 304 from a fiber optic cable 108 for portions of the fiber optic cable 108 that are above an insulation layer 132.

The controller 136 may further include a fracture deviation module 316. The fracture deviation module 316 detects a fracture-borehole deviation 318 based on the temperatures 304 indicated by each of the temperature detectors 202 and the approximately known depths 310 and radial angles 312. The fracture deviation module 316 may determine the fracture-borehole deviation 318 based on a first fracture indicator 320 occurring on a first side 322 of the borehole, and a second fracture indicator 324 occurring on an opposite side 328 of the borehole, where the first fracture indicator 320 occurs at a top of an observed injection region 330, and the second fracture indicator 324 occurs at the bottom of the observed injection region 330. Refer to the section referencing FIG. 7 for a geometrical illustration of the fracture deviation module 316 determining a fracture-borehole deviation 318.

In one embodiment, the fracture intersects the first temperature detector 202 at the top of the observed injection region 330 on one side 322 of the borehole 112, and the fracture intersects a second temperature detector 202 at the bottom of the observed injection region 330 on a second side 328 of the borehole 112 that is different from the first side, but not opposite the first side. Refer to the section referencing FIG. 7 for a description of the fracture deviation module 316 determining a fracture-borehole deviation 318 where the first and second sides are not opposite sides. When a fracture-borehole deviation 318 is present, the controller 136 may set a control flag or other indication that an observed injected fluid 126 vertical extent 134 may not reflect the true injected fluid 126 vertical extent 134.

The observed injection region 330 comprises the set of all temperatures 304 showing temperature response to injected fluid 126. In one embodiment, the thermal detectors 202 comprise axial segments of a fiber optic cable 108 wrapped helically around at least a portion of the thermal insulator 132. When a fracture intersects the borehole 112 but has a deviation from the borehole 112, the fracture may intersect one temperature detector 202 at the top of the observed injection region 330 on one side of the borehole 112, and the fracture may intersect a second temperature detector 202 at the bottom of the observed injection region 330 on an opposite side of the borehole 112.

In one embodiment, the observed injection region 330 has a highest fracture indicator 320 and a lowest fracture indicator 324. When a fracture is in the region of the borehole 112, the fracture communicates around one side of the borehole 112. Where the temperature detectors 202 comprise a fiber optic cable 108 wrapped helically around the borehole 112, the fiber optic cable 108 will show a broad temperature response to the fracture as about 180 degrees, or one-half of a helical loop, are exposed to the cooled area of the fracture. Where the fracture leaves the region of the borehole 112, the fiber optic cable 108 will show a narrowed temperature response to the fracture as less than 180 degrees are exposed to the cooled area of the fracture. In one embodiment, the fracture deviation module 316 detects a fracture-borehole deviation 318 when a highest fracture indicator 320 and a lowest fracture indicator 324 exhibit a narrower temperature response than at least one central fracture indicator (not shown) between the highest 320 and lowest 324 fracture indicators.

The controller 136 may further include an injection modification module 332 that monitors the vertical extent 134 of the injected fluid 126. The injection modification module 332 adjusts an injection parameter 334 based on the vertical extent 134 of the injected fluid 126. The injection parameter 334 may be an injected fluid viscosity, pumping rate, and/or proppant concentration. For example, the vertical extent 134 of the injected fluid 126 may indicate that excessive fracture height growth is occurring, and the injection modification module 332 may reduce the injected fluid viscosity and/or reduce the injected fluid pumping rate to reduce the fracture height growth. The injection modification module 332 may include an operator that adjusts the injection parameters 334, may communicate with an operator that adjusts the injection parameters 334, and/or may automatically adjust the injection parameters 334 through actuators in communication with the controller 136.

Various methods of reducing the fluid viscosity of a fracturing fluid in real time are known in the art, but may include without limitation: mixing two different pre-hydrated base gel weights to match a viscosity command (e.g. changing the ratio of mixing a 30-lb/1000-gal and a 50-lb/1000-gal guar gel), utilizing a quick-hydrating gel and changing the gel weight in real time, mixing a viscoelastic surfactant (VES) in a lower concentration as a fracturing fluid, changing a cross-linker and/or breaker schedule for a fracturing fluid, and the like. All known methods of changing a fracturing fluid viscosity in real time are contemplated within the scope of the present invention.

In one embodiment, the injection modification module 332 adjusts the proppant concentration, i.e. the amount of sand or other proppant material per unit of fracturing fluid (for example, as measured in "pounds per gallon") entrained with a fracturing fluid based on the vertical extent 134. For example, excessive height growth of a fracture can indicate that a screen-out is going to occur because of potential dramatic increases in fluid loss, and/or can indicate that a fracture treatment should end if the undesired fracture induction into non-productive zones (e.g. 114B, 114C) makes further treatment non-economic. Therefore, in one embodiment, a proppant concentration is decreased, or proppant addition is discontinued completely, when the injection modification module 332 detects excessive fracture height growth. Decreasing the proppant concentration reduces the amount of proppant left in the borehole 112 if the treatment must be ended, for example due to excessive pressures induced by a screen-out.

In one embodiment, a proppant concentration is increased in response to excessive height growth such that when the treatment is discontinued, the final proppant concentration entering the formation 114 is high creating a high conductivity fracture near the borehole 112. The selection of the appropriate injection modifications of the injection parameter(s) 334 are mechanical steps for one of skill in the art for a given apparatus 200 based on the injection zone 114A permeability, economic constraints for a particular application, and the disclosures herein. For example, a high permeability injection zone 114A for a high priority well may indicate an increase in proppant concentration in response to a large vertical extent 134, because proppant cleanout costs in the borehole 112 may not be as important as achieving high proppant concentrations in the fracture near the borehole 112.

The controller 136 may include a calibration module 336 that calibrates a fracture propagation model 338 based on the vertical extent 134 of the injected fluid 126. In one embodiment, the calibration module 336 adjusts a formation fracture gradient, a formation Young's modulus, a fluid leakoff coefficient, and/or a fluid viscosity estimate to match a modeled fracture height 340 to the vertical extent 134. The formation fracture gradient and Young's modulus may be the parameters for any zone 114A-114D of the formation involved with the fracture treatment. The calibration module 336 may be software code operating on a computer, and/or an operator monitoring a fracture treatment and adjusting parameters to match the modeled fracture height 340 to the vertical extent 134.

FIG. 4 is an illustration 400 of one embodiment of a fiber optic cable 108 with a configurable number of turns per borehole 112 axial distance in accordance with the present invention. FIG. 4 is a schematic illustration only, and is not intended to show scale or unnecessary features of the embodiment. In one embodiment, the fiber optic cable 108 is configured with more helical turns in areas of the borehole 112 where greater temperature resolution is desirable. For example, the fiber optic cable 108 may have relatively few turns 402 through an area of the formation 114 where fracture growth is expected and not a concern (e.g. the injection zone 114A) and more turns 404 through an area of the formation where a barrier is present (e.g. a boundary layer 114B) and detailed knowledge of fracture growth through the barrier is desirable. In one embodiment, a configurable number of turns may comprise a vertical section (not shown) of the fiber optic cable 108, which may be described as zero helical turns per borehole 112 axial distance.

FIG. 5 is an illustration of one embodiment of a fiber optic cable 108 with switchback groupings progressing helically around the borehole 112 in accordance with the present invention. One issue that arises with high helical turn counts is that an axial segment comprising a temperature detector 202 in the fiber optic cable 108 may have an axial length long enough that the temperature value 304 is not measured within the required radial angle sweep (see the description referencing FIGS. 1 and 2). For example, in an embodiment where the required radial angle sweep is 120 degrees, one axial length of the cable 108 equal to the axial temperature resolution of the fiber optic cable 108, and with the desired borehole depth resolution may take up more than 120 radial degrees, and the controller 136 may have difficulty resolving the radial angle 312 of a given temperature value 304.

In one embodiment, greater radial and borehole axial resolution is achievable utilizing groupings, for example switchback groupings 502A, 502B, 502C. Each switchback grouping 502A, 502B, 502C progresses helically around the borehole 112. While the switchback groupings 502A, 502B, 502C depicted in the embodiment of FIG. 5 progress at sequential radial angles 312 around the borehole 112—for example at 0, 90, 180, 270 degrees, groupings need not proceed sequentially, but need only proceed such that the location conversion module 308 can determine the radial angle 312 of each temperature detector 202 (i.e. each axial length segment of the fiber optic cable 108). For example, in one embodiment, sequential groupings may occur at 0, 270, 180, and 90 degrees thereby giving adjacent groupings a greater radial angle difference and potentially greater temperature contrast.

The switchback groupings 502A, 502B, 502C provide the requisite fiber optic cable 108 length according to the axial resolution of the fiber optic cable 108 temperature detection system, while keeping the measurement within a radial angle 312 sweep sufficient to resolve the temperature 304 reading as occurring at a specific angle. For example, a switchback grouping for a fiber optic cable 108 with a long-term bend radius of 17 mm on the surface of an 11.4 cm insulation layer 132 (4.5 inches) can place 1 meter of fiber optic cable 108 within a 120 degree sweep of radial angle with about 8 switchbacks, over an axial borehole 112 length of about 27 cm. The example configuration thus allows 120 degree radial angle resolution with 4 temperature measurements 304 per meter of borehole 112 axial length.

While switchback groupings 502A, 502B, 502C are illustrated to give an example of confining a given axial length of the fiber optic cable 108 within a given borehole depth and radial angle sweep, other grouping configurations will be clear to one of skill in the art and are contemplated within the scope of the present invention. For example, and without limitation, spiral groupings (not shown) can be utilized based on the long-term bend radius of available fiber optic cable 108, and the radial angle sweep and borehole depth resolution requirements. The temperature detectors 202 may thereby comprise axial segments of a fiber optic cable 108 arranged as a plurality of groupings, each grouping comprising a specified axial length of the fiber optic cable 108 disposed within a defined radial angle sweep and borehole depth, wherein the plurality of groupings progress helically around the borehole.

In another example, a fiber optic cable 108 is run in a borehole 112 outside the casing 116 in the cement layer 118. In the example, assuming the helical turns of the fiber optic cable occur on an equivalent of an 18 cm (7 inch) cylinder, a switchback grouping for a fiber optic cable 108 with a long-term bend radius of 17 mm can place one meter of fiber optic cable 108 within 120 degrees of radial angle 312 with about five switchbacks, over an axial borehole 112 length of about 17 cm. The example configuration thus allows 120 degree radial angle resolution with almost six temperature measurements 304 per meter of borehole 112 axial length.

Lower bend radius cable than 17 mm, and fiber optic cable 108 with superior resolution for temperature measurement than one meter, is available commercially. Higher resolution fiber optic cable 108 may reduce or eliminate the use of switchback groupings even where high helical turn rates are desirable. It is a mechanical step for one of skill in the art to implement switchback groupings 502 with a fiber optic cable 108. For example, a fiber optic cable 108 may be placed in the borehole 112 disposed within a frame (not shown), or disposed within an articulated groove on the insulation layer 132.

Figure 6A:
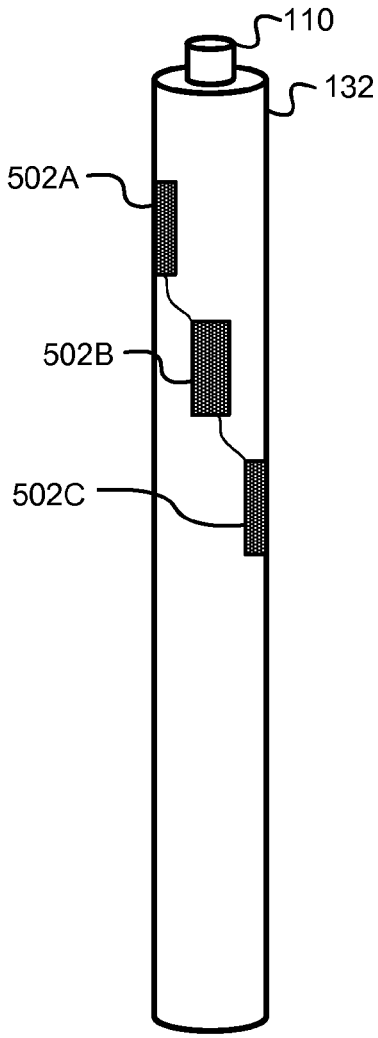
FIG. 6A is an illustration of one embodiment of switchback groupings progressing helically around the borehole in accordance with the present invention.
Figure 6B:
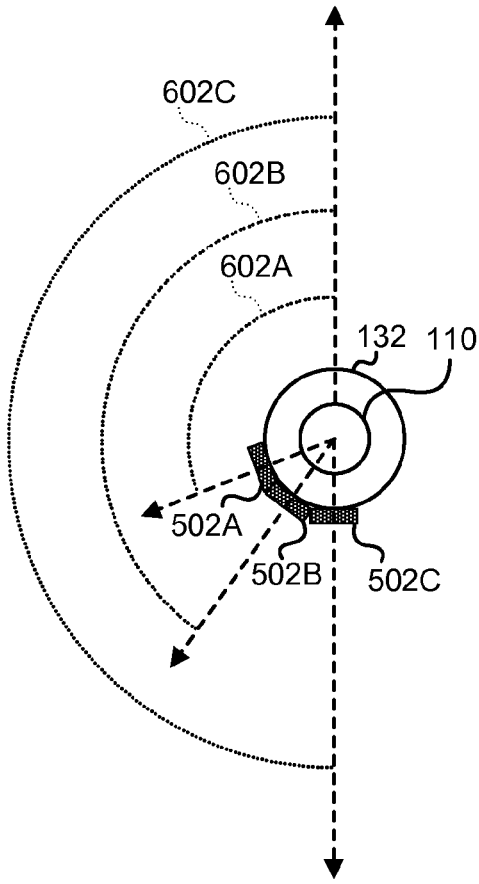
FIG. 6B is an illustration of one embodiment of temperature detectors and corresponding radial angles in accordance with the present invention.

FIG. 6A is an illustration of one embodiment of switchback groupings 502A, 502B, 502C progressing helically around the borehole 112 in accordance with the present invention. Referring to FIG. 6B, FIG. 6B is an illustration of one embodiment of temperature detectors 202 and corresponding radial angles 602A, 602B, 602C in accordance with the present invention. FIG. 6B is consistent with a top-view illustration of FIG. 6A, wherein the temperature detectors 202 are switchback groupings 502A, 502B, 502C. The temperature detector 502A is shown at a radial angle 602A, which may be an absolute or relative radial angle 312. For example, the radial angle 602A may be used as a baseline angle of zero degrees, and the radial angle 602B may be measured from 602A. In one embodiment, the azimuthal values of the radial angles 602A, 602B, 602C may be known, and the radial angles 602A, 602B, 602C may be measured from a reference angle defined as zero degrees.

The radial angles 602A, 602B, 602C are shown for temperature detectors 202 as switchback groupings 502A, 502B, 502C of a fiber optic cable 108. The temperature detectors 202 may be any detectors known in the art, including thermistors, thermocouples, and axial segments of a fiber optic cable 108 based on the axial resolution of the fiber optic cable 108. In one embodiment, the temperature detectors 202 comprise axial segments of a fiber optic cable 108 wound helically around the borehole 112, and the radial angle 312 of each temperature detector 202 comprises the average radial angle of an axial segment of the fiber optic cable 108 based on the fiber optic cable 108 arrangement within the borehole 112.

Figure 7:
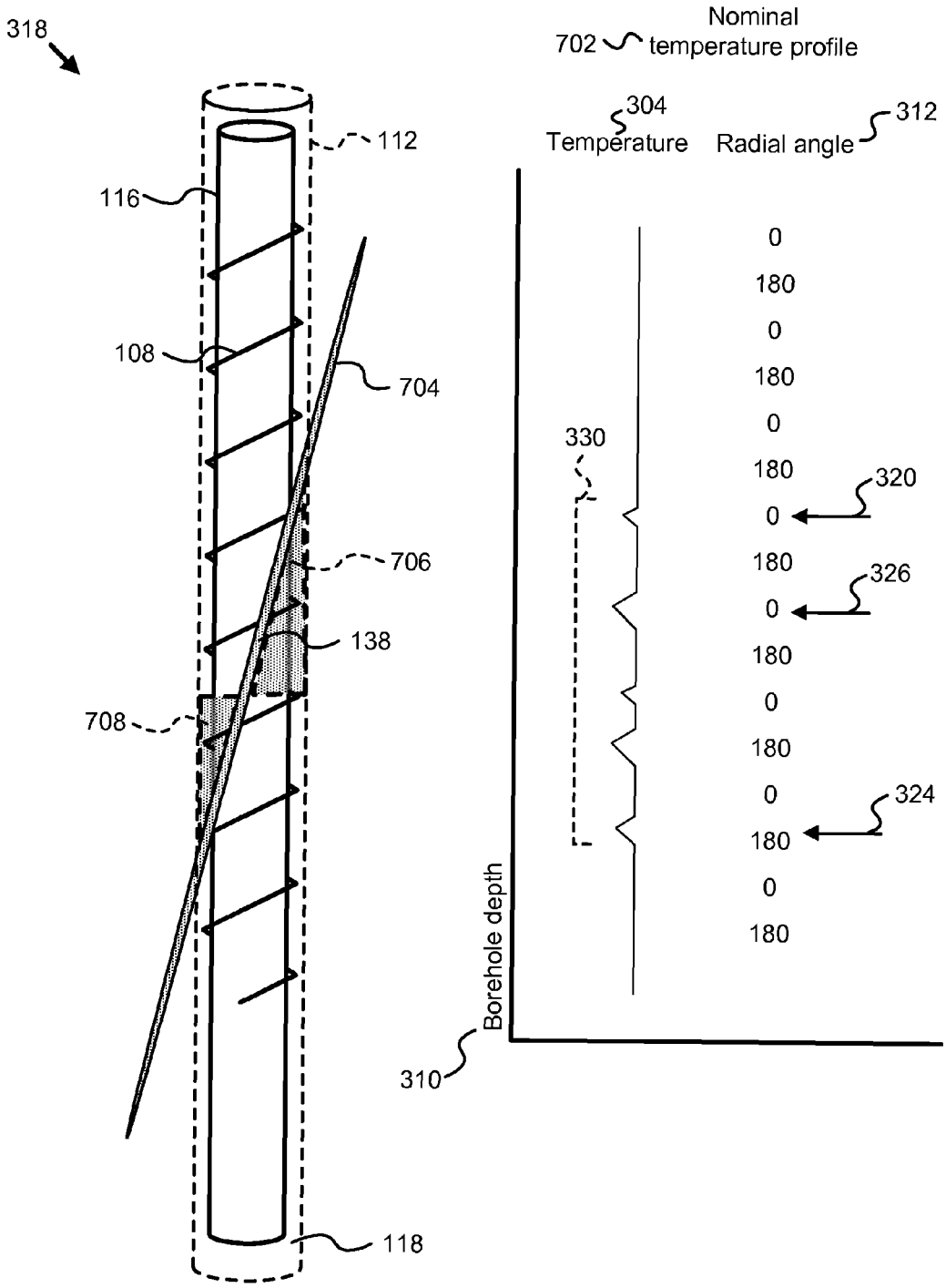
FIG. 7 is an illustration of a fracture-borehole deviation in accordance with the present invention.

FIG. 7 is an illustration of a fracture-borehole deviation 318 in accordance with the present invention. A nominal temperature profile 702 is shown on FIG. 7, with temperature values 304, each temperature value 304 having a corresponding borehole depth 310 and radial angle 312. The details of the nominal temperature profile 702 will vary according to the temperature detectors 202 utilized, including the placement, arrangement, and resolution of the detectors 202. In the embodiment illustrated in FIG. 7, the temperature detectors 202 comprise axial segments of a fiber optic cable 108 wound helically around the borehole 112 in the cement sheath 118 as shown.

A fracture 704 intercepts the borehole 112 at the point of fluid injection 138 where the fracture 704 is induced by injected fluid 126. The fracture 704 has two wings (perpendicular to FIG. 7, not shown), and the wings of the fracture 704 communicate across the borehole 112 behind the cement sheath 118. The fracture 704 has an upper contact region 706 and a lower contact region 708 wherein the wings of the fracture 704 are in fluid communication. The fiber optic cable 108 will read a temperature response 304 due to injected fluid 126 at the contact regions 706, 708.

In one embodiment, a first fracture indicator 320 occurs at a top of an observed injection region 330 based on the first temperature detector 202 that detects a fracture 704, with the temperature determination module 302 evaluating from the top down. In one embodiment, a second fracture indicator 324 occurs at a bottom of the observed injection region 330 based on the first temperature indicator 202 that detects the fracture 704, with the temperature determination module 302 evaluating from the bottom up. In one embodiment, the first fracture indicator 320 occurs on an opposite side from the second fracture indicator 324.

For example, in the illustration of FIG. 7, referring to the nominal temperature profile 702, the first fracture indicator 320 occurs at a relative radial angle 312 of about zero degrees, and the second fracture indicator 324 occurs at a relative radial angle 312 of about 180 degrees. As the fracture 704 leaves the area of the borehole 112, for example as shown at the borehole depths for 320 and 324, each temperature signal 304 will become narrower than previous temperature signals where a fiber optic cable 108 is utilized because a smaller axial range of the cable 108 is exposed to the contact region 706, 708. For example, the temperature value 326 is shown as a larger signal than the first fracture indicator 320 in the example of FIG. 7. Therefore, in one embodiment, the fracture deviation module 316 determines that a fracture-borehole deviation 318 has occurred by determining that the highest 320 and lowest 324 fracture indicators exhibit a narrower temperature response 304 than at least one central fracture indicator (e.g. fracture indicator 326).

In one embodiment, the fracture deviation module 316 determines a fracture-borehole deviation 318 based on the temperatures 304, and the corresponding borehole depth values 310 and radial angles 312. In one embodiment, the fracture deviation module 316 determines a fracture-borehole deviation 318 based on the first fracture indicator 320 occurring on one side of the borehole 112, and a second fracture indicator 324 occurring on the opposite side of the borehole 112, wherein the first fracture indicator 320 occurs at a top of an observed injection region 330, and the second fracture indicator 324 occurs at a bottom of the observed injection region 330.

Deviations in the resolutions and locations of the temperature detectors 202 may cause the first fracture indicator 320 and second fracture indicator 324 to have substantially different radial angles 312, but to not have radial angles 312 indicating opposite sides of the borehole 112. In one embodiment, the fracture deviation module 316 determines a fracture-borehole deviation 318 based on the first fracture indicator 320 occurring on a first side of the borehole 112 at a highest observed fracture location 320, and determining that the fracture appears on a second side of the borehole 112 at a lowest observed fracture location 324. Therefore, in one embodiment, the fracture deviation module 316 determines that a fracture-borehole deviation 318 has occurred by determining that a highest 320 and lowest 324 fracture indicator occur at opposite sides of the borehole 112, and/or at differing radial angles 312 of the borehole 112.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 8:
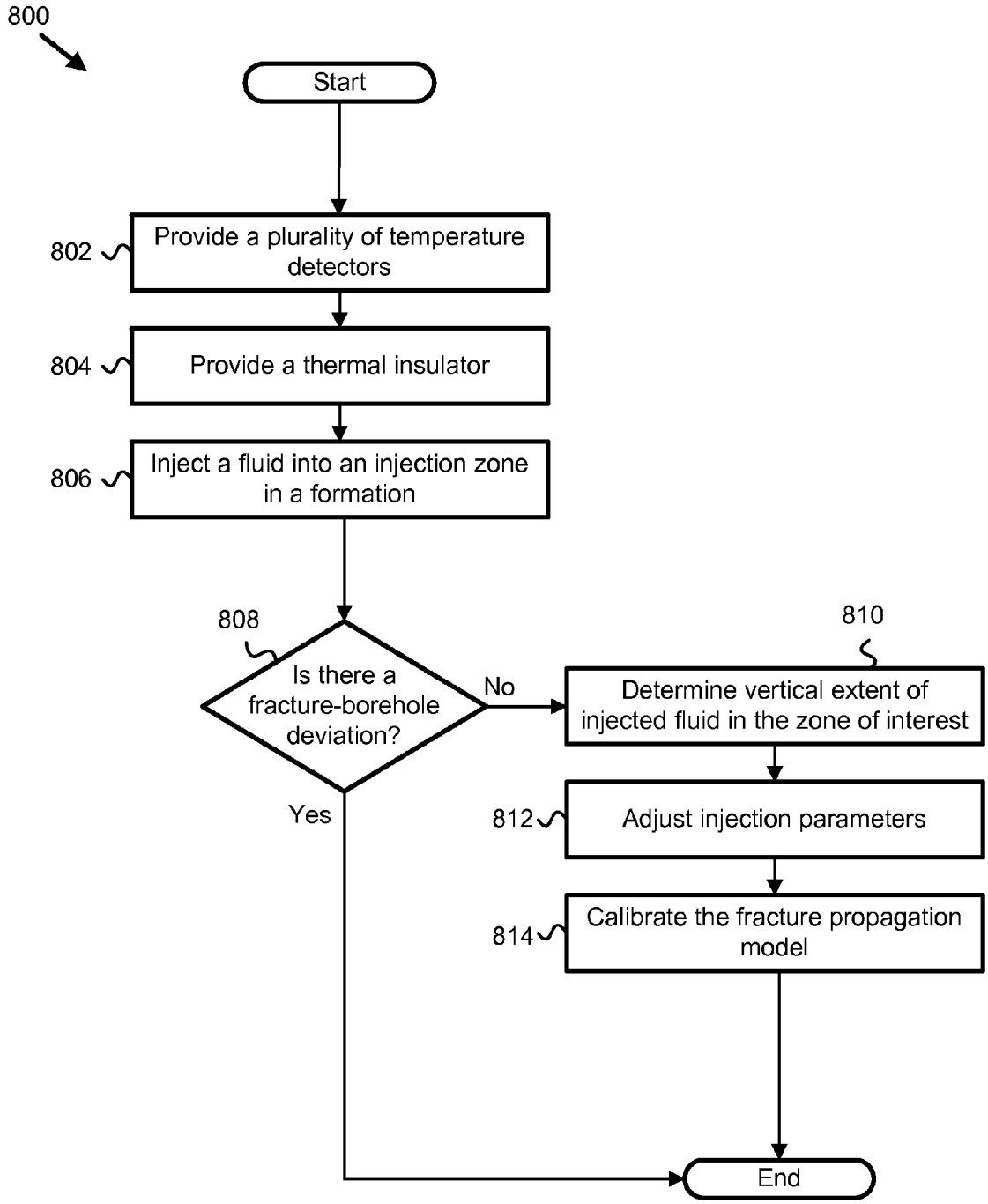
FIG. 8 is a schematic flow diagram illustrating one embodiment of a method for determining vertical placement of injected fluid in accordance with the present invention.

FIG. 8 is a schematic flow diagram illustrating one embodiment of a method 800 for determining vertical placement of injected fluid in accordance with the present invention. The method 800 includes providing 802 a plurality of temperature detectors 202, each temperature detector 202 providing a temperature estimate 304 at an approximately known depth of the borehole 310. In one embodiment, each temperature estimate 304 is also at an approximately known radial angle within the borehole 312. A temperature determination module 302 may interpret a signal 306 to determine the temperature estimates 304. The temperature detectors 202 may be axial segments of a fiber optic cable 108 arranged in the borehole 112 by helically arranging the cable 108 in the borehole 112, by helically arranging the cable 108 in the borehole 112 with a configurable number of turns per borehole axial distance in the borehole 112, and/or by arranging the cable 108 in switchback groupings 502 that proceed helically around the borehole 112.

The method 800 further includes providing 804 a thermal insulator 132 that thermally isolates the temperature detectors 202 from an injection conduit 110, 128 across a zone of interest in a formation 114. The method 800 further includes injecting 806 a fluid into an injection zone 114A in a formation 114. In one embodiment, the method 800 includes a fracture deviation module 316 detecting 814 a fracture-borehole deviation 318. If a fracture-borehole deviation 318 exists, the fracture deviation module 316 may set a control flag to note the deviation 318, and end the method 800. In one embodiment, the fracture deviation module 316 may allow the method 800 to proceed even where a fracture-borehole deviation 318 is detected, and the fracture deviation module 316 may store the control flag noting the fracture-borehole deviation 318.

The method 800 further includes a fluid placement module 314 determining 810 a vertical extent 134 of the injected fluid 126 in the formation 114 based on the temperatures 304 indicated by each temperature detector 202. The method 800 may further include an injection modification module 332 adjusting 812 an injection parameter 334 based on the vertical extent 134. In one embodiment, the method 800 includes a calibration module 336 calibrating 814 a fracture propagation model 338 to match a modeled fracture height to the vertical extent 134 of the injected fluid 126.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope. Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment. Furthermore, the described features, advantages, and characteristics of the invention may be combined in any suitable manner in one or more embodiments.

What is claimed is:

1. A method for determining vertical placement of injected fluid, the method comprising:

providing a plurality of temperature detectors, each of the plurality of temperature detectors configured to provide a temperature estimate at an approximately known depth of a borehole, the detectors disposed at various radial angles around the borehole and configured to provide each temperature estimate at an approximately known radial angle within the borehole, the known radial angle comprising a relative radial angle and/or an absolute radial angle;

providing a thermal insulator having a first thermal conductivity configured to thermally isolate the plurality of temperature detectors from an injection conduit and extending across a zone of interest in a formation, wherein the first thermal conductivity is lower than a second thermal conductivity of materials between the formation and the plurality of temperature detectors;

injecting a fluid through the injection conduit into an injection zone in the formation; and determining a vertical extent of the injected fluid in the formation across the zone of interest based on the temperature estimate for each temperature detector; and detecting a fracture-borehole deviation when a highest fracture indicator and a lowest fracture indicator exhibit a narrower temperature response than at least one central fracture indicator.

2. The method of claim 1, wherein the zone of interest comprises a vertical distance above the injection zone.

3. The method of claim 2, wherein the insulation layer extends across the zone of interest from the injection zone to a boundary layer in the formation.

4. The method of claim 1, wherein the radial angle of each of the plurality of temperature detectors is known to a resolution of less than about 120 degrees.

5. The method of claim 1, the method further comprising detecting a fracture-borehole deviation when a highest fracture indicator and a lowest fracture indicator exhibit a narrower temperature response than at least one central fracture indicator.

6. The method of claim 1, wherein the plurality of thermal detectors comprise axial segments of a fiber optic cable distributed through the zone of interest by a method selected from the group consisting of helically arranging the fiber optic cable in the borehole, helically arranging the fiber optic cable with a configurable number of turns per borehole axial distance in the borehole, and arranging the fiber optic cable in a plurality of switchback groupings wherein the switchback groupings progress helically around the borehole.

7. The method of claim 1, further comprising monitoring the vertical extent of the injected fluid, and adjusting an injection parameter based on the vertical extent, wherein the injection parameter comprises a member selected from the group consisting of an injection fluid viscosity, an injection fluid pumping rate, and an injection fluid proppant concentration.

8. The method of claim 1, further comprising calibrating a fracture propagation model based on the vertical extent of the injected fluid, wherein calibrating the fracture propagation model comprises adjusting at least one model parameter to match a modeled fracture height to the vertical extent of the injected fluid, wherein each model parameter is selected from the list consisting of a formation fracture gradient, a formation Young's modulus, a fluid leakoff coefficient, and a fluid viscosity estimate.

9. The method of claim 1, wherein providing the plurality of temperature detectors further comprises determining a required radial angle resolution required for a given application.

10. An apparatus for determining vertical placement of injected fluid, the apparatus comprising:

a plurality of temperature detectors, wherein each of the plurality of temperature detectors is placed at an approximately known depth within a borehole and at an approximately known radial angle, around the borehole, wherein the radial angles of each of the temperature detectors are not equal;

a thermal insulator having a first thermal conductivity interposed between an injection conduit and the plurality of temperature detectors and extending across a zone of interest in a formation;

a pump configured to inject a fluid through the injection conduit into an injection zone in the formation; wherein the first thermal conductivity is lower than a second thermal conductivity of materials between the formation and the plurality of temperature detectors;

a temperature determination module configured to interpret at least one signal from the plurality of temperature detectors, and to determine a temperature estimate for each temperature detector; and a fluid placement module configured to determine a vertical extent of the injected fluid across the zone of interest based on the temperature estimate for each temperature detector.

11. The apparatus of claim 10, further comprising a fracture deviation module configured to detect a fracture-borehole deviation based on the temperature estimate for each temperature detector, and the approximately known depths and the approximately known radial angles of the plurality of temperature detectors.

12. The apparatus of claim 11, wherein the fracture deviation module is further configured to detect the fracture-borehole deviation based on a first fracture indicator occurring on one side of the borehole, and a second fracture indicator occurring on an opposite side of the borehole, wherein the first fracture indicator occurs at a top of an observed injection region, and the second fracture indicator occurs at a bottom of the observed injection region.

13. The apparatus of claim 11, wherein the plurality of thermal detectors comprise a plurality of axial segments of a fiber optic cable disposed within the borehole, wherein the fiber optic cable is wrapped helically around at least a portion of the thermal insulator.

14. The apparatus of claim 10, wherein the injection conduit comprises at least one member selected from the group consisting of a tubing string, a coiled tubing string, a casing, and a casing annulus.

15. The apparatus of claim 10, wherein the thermal insulator comprises a member selected from the group consisting of an insulated tubing wall, a casing and cement layer, and an insulation material sheath.

16. The apparatus of claim 10, wherein the plurality of thermal detectors comprise axial segments of a fiber optic cable disposed within the borehole.

17. The apparatus of claim 16, wherein the fiber optic cable continues below a fluid injection point.

18. The apparatus of claim 16, wherein the fiber optic cable has a distributed arrangement across a zone of interest in the borehole, the distributed arrangement comprising a member selected from the group consisting of:

a helical arrangement;

a helical arrangement with a configurable number of turns per borehole axial; distance; and a plurality of groupings, each grouping comprising a specified axial length of the fiber optic cable disposed within a defined radial angle sweep and borehole depth, wherein the plurality of groupings progress helically around the borehole.

19. The apparatus of claim 10, wherein the temperature detectors define a predetermined radial angle resolution for injecting the fluid.

20. A system for providing a service for determining a vertical placement of an injected fluid, the system comprising:

a coiled tubing unit comprising an injector head and a coiled tubing string, the coiled tubing string defining an injection conduit;

an optical fiber having a plurality of axial and radial locations thereon disposed within the coiled tubing string;

a bottom hole assembly disposed at the end of the coiled tubing string and comprising a plurality of crossover ports such that the optical fiber crosses from an interior of the coiled tubing string to an exterior of the bottom hole assembly, wherein injected fluid flows along the interior of the coiled tubing string to an interior conduit of the bottom hole assembly, the bottom hole assembly further comprising an insulation layer having a first thermal conductivity interposed between the interior conduit of the bottom hole assembly and the optical fiber and extending across a zone of interest in a formation; wherein the first thermal conductivity is lower than a second thermal conductivity of materials between the formation and the optical fiber;

a controller comprising:

a temperature determination module configured to interpret at least one signal from the fiber optic cable, and to determine a temperature estimate for each of a plurality of axial locations along the fiber optic cable;

a location conversion module configured to convert the axial locations along the fiber optic cable to a plurality of corresponding approximate depths in the borehole, and to a plurality of corresponding approximate radial angles, each radial angle comprising one of a relative radial angle and an absolute radial angle; and a fluid placement module configured to determine a vertical extent of the injected fluid across the zone of interest based on the temperature estimate for each axial location, and based on the corresponding depth in the borehole and radial angle for each of the axial locations.

21. The system of claim 20, further comprising a pumping unit having access to an injection fluid source, the pumping unit fluidly coupled to the coiled tubing, string, and wherein the controller further comprises:

an injection modification module configured to monitor the vertical extent of the injected fluid, and to adjust an injection parameter based on the vertical extent of the injected fluid, wherein the injection parameter comprises at least one member selected from the group consisting of an injection fluid viscosity, an injection fluid pumping rate, and an injection fluid proppant concentration; and a fracture deviation module configured to detect a fracture-borehole deviation based on the temperature estimate for each axial location, and based on the corresponding depth in the borehole and radial angle for each of the axial locations.

* * * * *